United States Patent [19]

MacBean

[11] 4,095,622

[45] Jun. 20, 1978

[54] WOVEN SEAM IN FABRIC AND METHOD OF MAKING SAME

[75] Inventor: Donald George MacBean, Pierrefonds, Canada

[73] Assignee: JWI Ltd., Montreal, Canada

[21] Appl. No.: 744,323

[22] Filed: Nov. 23, 1976

[30] Foreign Application Priority Data

Nov. 27, 1975 United Kingdom ..... 48826/75

[51] Int. Cl.[2] ..... D03D 25/00; D21F 1/12; D21F 7/10

[52] U.S. Cl. ..... 139/383 A; 28/141; 162/DIG. 1; 245/10

[58] Field of Search ..... 139/383 A, 425 A; 28/72 R, 141; 245/10; 162/DIG. 1, 348, 349, 358

[56] References Cited

U.S. PATENT DOCUMENTS

| | | | |
|---|---|---|---|
| 3,225,900 | 12/1965 | MacBean et al. | 139/383 A |
| 3,283,388 | 11/1966 | Kelleher et al. | 28/72 R |
| 3,436,041 | 4/1969 | Haller | 245/10 |
| 3,900,659 | 8/1975 | MacBean | 139/383 A |
| 4,006,760 | 2/1977 | Romanski | 139/383 A |

FOREIGN PATENT DOCUMENTS

| | | | |
|---|---|---|---|
| 207,239 | 2/1909 | Germany | 245/10 |
| 2,126,995 | 1/1973 | Germany | 162/348 |
| 47-43,762 | 11/1972 | Japan | 139/383 A |
| 524,181 | 7/1940 | United Kingdom | 245/10 |
| 928,477 | 6/1963 | United Kingdom | 139/383 A |

*Primary Examiner*—James Kee Chi
*Attorney, Agent, or Firm*—Charles E. Brown

[57] ABSTRACT

A woven fabric and a method of forming a seam therein comprising a woven fabric as used for supporting a paper web on a paper making machine. The fabric has interwoven weft and warp strands with the strands in the machine direction being flexible strands incapable of retaining a stable crimp. The improvement in the fabric comprises a plurality of spaced apart replacement monofilament strands having stable crimp characteristics extending in the machine direction and in a seam area for interconnecting opposed ends of the fabric to form an endless belt having a seam which is substantially flat. The replacement strands have crimps of the same configuration as crimps in the machine direction strands of the fabric.

13 Claims, 5 Drawing Figures

WOVEN SEAM IN FABRIC AND METHOD OF MAKING SAME

BACKGROUND OF INVENTION

1. Field of the Invention

This invention relates to a seam for joining together the ends of woven fabric to form an endless belt. It is applicable more specifically to joining the ends of woven synthetic dryer fabrics as used in the dryer section of paper making machines and is particularly applicable to joining the ends of those dryer fabrics which have very pliable or multifilament yarns in at least the machine direction of the fabric.

2. Description of Prior Art

Dryer fabrics are usually woven of natural or synethethic fibres such as, for example, polyesters, nylons, acrylics, bulked or of interwoven layered structure to produce a heavy woven fabric which can be, for example, from about 1/32 to about ⅛ of an inch thick. Dryer fabrics are supplied in various widths from about 5 feet to about 30 feet depending on the width of the paper machine, and in length from about 40 feet to about 350 feet.

It is common practice to weave the dryer fabric as a long wide flat single piece and then join the ends on the machine to make an endless belt. There are several known methods of making the joint or seam as it is called. In one method, each end of the fabric is provided with a set of metal clipper type loops. In another method, metal or plastic loops are sewn into the ends which have been reinforced to prevent unravelling. In still another method, cross machine strands(weft) are removed near the ends of the fabric and the ends are folded back in such a way that warp loops in the unwefted sections project. In each case the joint is completed when the array of loops at one end is intermeshed with the array of loops at the other end and brought into register to form a tubular passage through which a hinge pin or pintle wire is inserted.

These above known conventional methods of making a seam in heavy dryer fabrics all have the disadvantage of either producing a gross lump which causes sheet disturbance and marking or an almost complete mesh blockage. Either of these features being objectional from the point of view of fabric wear or quality of sheet.

Another type of seam that has been successfully used in dryer fabrics having monofilament longitudinal strands capable of retaining a stable crimp is a loop type wherein the loops are formed at each end edge in the following manner. Projecting longitudinal (machine direction) strands from which cross strands have been removed at each end of the fabric are interwoven again into a plurality of added cross strands comprising either the removed or similarly crimped strands in the seam area. Selected longitudinal strands are looped over a forming rod at the end edge of the plurality of added cross strands and are woven back into the added cross strands to meet the ends of adjacent machine direction strands which have been woven part way into the group of added cross strands and terminated. The surplus ends of these longitudinal strands are subsequently clipped off at the surface of the cloth in the seam area where they meet to form abutting terminations. Those longitudinal strands that are not looped over the forming rod are simply looped tightly over the last added cross strand and similarly woven back into the seam area to meet an adjacent longitudinal strand at an abutting termination. Abutting termination points of the longitudinal strands are positioned in a predetermined uniform pattern throughout the seam area to avoid having them clustered together where they might obstruct the mesh unduly or cause a surface lump or a weakness of tensile strength in the joint.

A forming rod is looped in as described above at each end of the fabric and when it is required to join the ends of the fabric on the paper machine, the forming rods are withdrawn, the loops are intermeshed and the hinge pin (pintle wire) is inserted.

The advantage of this type of seam is that the continuity of mesh at each end, right up to the formed loops, is maintained without a layered thickening and without a discernible mesh blockage. The success of making such a seam depends upon stability of crimp in the longitudinal strands. The strength of the seam is controllable and determined by the number and strength of the looped longitudinal strands and by the number of added cross strands through which the crimped longitudinal strands are interwoven.

While this type of seam is ideal for joining the ends of dryer fabrics having monofilament longitudinal strands capable of retaining a crimp, it has not been possible to apply the method to dryer fabrics having, for example, multifilament longitudinal strands, which are generally pliable and do not have a stable cross-sectional dimension and crimp, although many attempts have been made to seam them in this way because of the physical and economic advantages which the multifilament strands offer.

The multifilament strands are generally made up of a large number of single fibers of very small diameter, twisted together to form a single flexible strand. Since these strands are normally quite limp the fabric made from them is generally coated with a thermo-setting resin material to stiffen it so that it will resist distortion in its own plane. While the coating of resin material does tend to make the multifilament strands less pliable it is generally only effective in this respect in the woven state and once disturbed, as when the strands are unwoven, the coating comes off and they again become pliable.

The problem encountered when attempting to seam fabrics comprising longitudinal multifilament or other strands incapable of holding a crimp is that the crimp is not stable after a strand is unwoven and it does not assume exactly the same configuration when re-woven in the seam area, thus the spacing of both the added cross strands and the longitudinal strands is affected. Multifilament strands tend to splay out and become bulky as well as limp and attempts to force them into place when re-weaving causes the seam area to become lumpy. Also, a point is soon reached, after weaving a number of multifilament strands, when it is impossible to force any more strands into the mesh. Attempts to alleviate this condition by cutting out say every 3rd, 4th or 5th multifilament strand reduces the lumpy effect to some extent but does not contribute to retention of uniform spacing of the additional cross machine strands and so the advantage of cutting out some of the longitudinal strands is lost. Further, limp longitudinal strands do not retain crimp sufficiently well to lock them into the added cross strands, through which they are interwoven and they tend to pull out of the mesh, thus weakening the seam.

SUMMARY OF INVENTION

The main feature of the present invention is to overcome the above-mentioned objectional conditions, encountered when attempting to join multifilament fabrics, or fabrics having longitudinal strands which do not hold a crimp, with a woven-back pin type seam, by substituting monofilament strands having stable crimp characteristics and having substantially the same size and woven crimp configuration, for some of the longitudinal strands in the seam area and particularly for those that would be used to form loops over the forming rod. In this way, because of the rigid crimps and compact nature of the monofilament replacement strands, all the cross machine and longitudinal strands in the seam area are able to assume the normal spacing of the corresponding strands in the fabric and the re-weaving in the seam area is accomplished without difficulty.

The main advantage of the inventive method of replacing, for example, some of the multifilament strands in the seam area with monofilament strands is that heavy dryer fabrics, woven with multifilament longitudinal strands for the sake of flexibility and economy, may now be joined as easily and with the same desirable properties as those dryer fabrics woven with monofilament longitudinal strands.

A further advantage of this invention is that it may be employed regardless of the complexity of the mesh pattern and it is therefore suitable for the double or triple layer meshes often employed in the weaving of many dryer fabrics.

A further feature of the invention resides in the fact that the method of replacing strands, in the seam area, which do not hold a crimp with monofilament strands capable of holding a crimp, may be used to make a factory joined seam as described in British Pat. No. 1,264,818 in which the two ends of the fabric are woven together with added cross strands to form an endless belt without a pintle wire.

In some cases where, for one reason or another, one type of material, having specific deficiency, is used for weaving the fabric, another type of material possessing a property lacking in the strands of the fabric, may be used for the replacement monofilament strands of the seam. An example of this would be the use of nylon for the replacement strands because of its known greater resistance to abrasion in spite of it having other properties that would make it unsuitable for use in the body of the fabric which may normally comprise polyester strands which are generally more stable than nylon in a moist environment.

In other cases, for example, it may be appropriate to use crimped replacement strands of metal such as stainless steel or metal coated with plastic material to provide added protection against corrosion.

According to the above features, from a broad aspect, the present invention provides a woven fabric as used for supporting a paper web on a paper making machine. The fabric has interwoven weft and wrap strands with the strands in the machine direction being flexible strands incapable of retaining a stable crimp. The improvement in the fabric comprises a plurality of spaced apart replacement monofilament strands having stable crimp characteristics extending in the machine direction and in a seam area for interconnecting opposed ends of the fabric to form an endless belt having a seam which is substantially flat. The replacement strands have crimps of the same configuration as crimps in the machine direction strands of the fabric.

According to a further broad aspect, there is provided a method of forming a seam in a paper machine fabric having interwoven weft and warp strands; the strands in at least the machine direction being flexible strands incapable of retaining a stable crimp, said method comprising: (i) removing a plurality of cross machine strands from an area in opposed end edge portions of said fabric, (ii) crimping a plurality of monofilament strands having stable crimp characteristics with a crimp identical to that in the strands of the fabric in said machine direction, (iii) substituting a plurality of said monofilament strands in said machine direction for at least some of the machine direction strands in the said opposed end edge portions, and (iv) interweaving said machine direction fabric strands and said monofilament strands in said machine direction with a plurality of said removed cross machine strands, or cross machine strands taken from identical fabric, to form a seam area.

BRIEF DESCRIPTION OF DRAWINGS

The invention will now be described with reference to the accompanying drawings in which.

DESCRIPTION OF PREFERRED EMBODIMENTS

Figure 1:
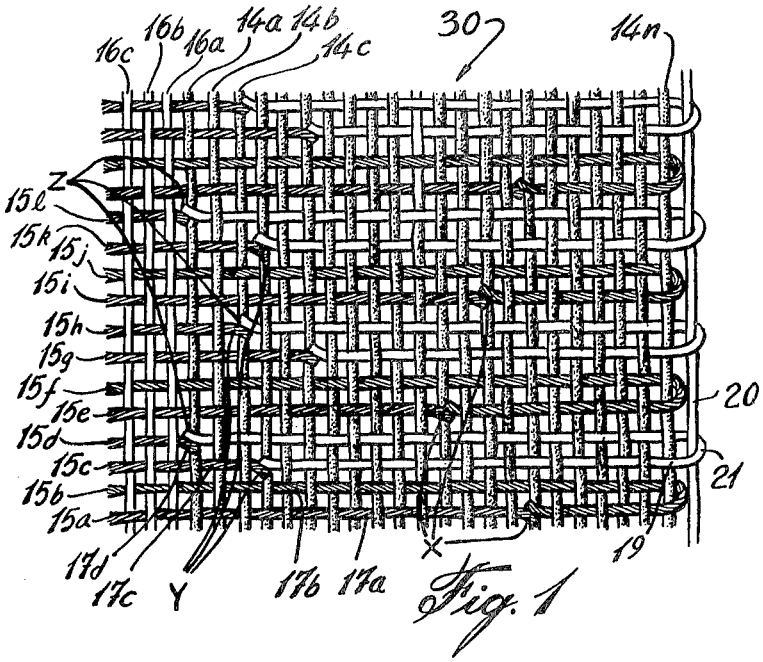
FIG. 1 is a partial plan view of a prepared end portion of a plain woven fabric having multifilament longitudinal yarns.

Referring to FIG. 1, there is shown an end portion 30 of a woven fabric belt of a type used in the dryer section of a paper making machine. For the sake of simplicity, a plain woven pattern is shown; it being understood that any other known pattern in the art of weaving paper making fabrics may be used. Numerals 15*a*, 15*b*, 15*c*, etc., designate multifilament longitudinal or machine direction strands (warp) of the one end of the fabric. Strands 16*a*, 16*b*, 16*c*, etc., are the cross machine strands (weft) of the fabric. A number of weft strands were previously removed from the end of the fabric leaving unwoven warp strands 17*a*, 17*b*, 17*c*, 17*d*, etc., which are continuations of fabric warp strands 15*a*, 15*b*, 15*c*, etc., projecting from the fabric. Added weft strands 14*a*, 14*b*, 14*c*, . . . 14*n* are the same strands that were previously removed, or are identical to the weft strands of the fabric from which the weft strands were removed. For the pattern of the seam end shown in FIG. 1, pairs of projecting warp strands 15*c* and *d* and 15*g* and *h* etc., were cut off short and alternate pairs 15*a* and *b* and 15*e* and *f*, etc., were left long. Then, one of each pair of long projecting strands, 15*b*, 15*f*, etc. is woven through the added weft strands 14*a*, 14*b*, 14*c*, etc., looped firmly around the last added weft strand, 14*n*, and woven back into the added weft strands towards the other of each pair, 15*a*, 15*e*, etc. which is woven partially through the plurality of added weft strands. These strands meet in the seam area between two added weft strands and are cut to terminate at X so that the cut ends lie adjacent to one another. The termination points of each pair of long projecting longitudinal strands, so woven, are placed in a staggered pattern symmetrically in the seam area so that they do not all lie between the same two added cross strands. The purpose of the series of short loops thus formed is to hold the last added weft strand, 14*n*, in place.

Where the pairs of short cut longitudinal strands occur, shown at 15*c* and *d*, 15*g* and *h*, etc. monofilament strands 19, having the equivalent diameter and substantially the same crimp as the longitudinal multifilament strands are woven from points Y, at the termination of 15*c*, 15*g*, 15*k*, etc., through the added cross strands, are looped around a forming rod 20 to form long loops 21 and are woven back through the added strands to meet the adjacent longitudinal multifilament strands 15*d*, 15*h*, 15*l*, etc. at points Z. These replacement monofilament strands 19 take the place of certain of the multifilament strands and form the loops 21 of a hinge type connection. The termination points of the multifilament and monofilament strands, where they come together at Y and Z in the seam area, are also placed in a staggered pattern to reduce the possibility of forming a massive mesh blockage, a lump on the surface of the seam area or a weakness in the seam.

The other or second end of the fabric is prepared with monofilament loops woven into added cross strands in exactly the same manner. The long and short loops may be displaced laterally by one pair in the second end so that, when the long loops at each end are intermeshed to form the tubular passage through which the pintle wire is inserted, the longitudinal strands at one end of the fabric will line up with the corresponding longitudinal strands at the other end of the fabric.

While alternate pairs of the multifilament longitudinal strands are shown in FIG. 1 as being replaced by monofilament looped strands, a similar seam, using the concept of the invention, may be made where parts of all or any number of the multifilament longitudinal strands in the seam area may be replaced by monofilament strands of the same size and crimp configuration.

Figure 2:
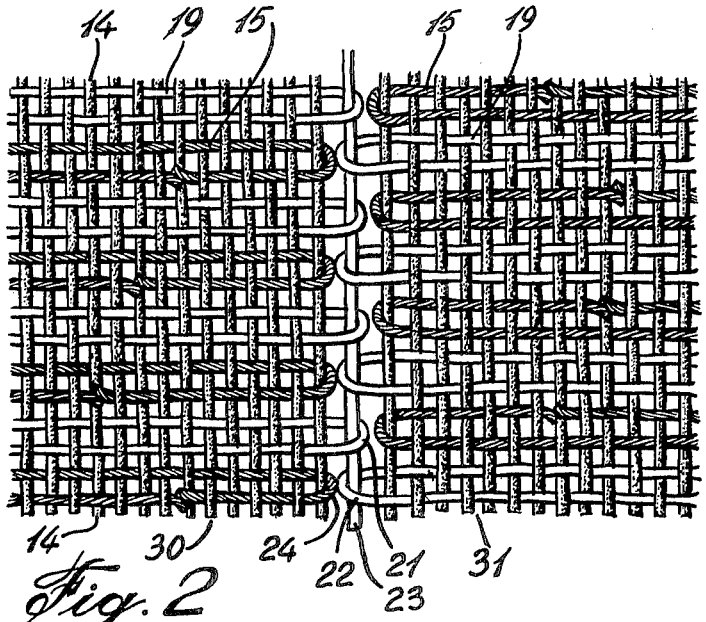
FIG. 2 is a partial plan view of the loop seam, with the loops intermeshed and joined with a hinge pin.

FIG. 2 shows the two end portions 30 and 31 of a fabric, prepared according to FIG. 1 and brought together. The forming rods have been removed and the monofilament loops 21 of the end edge of end portion 30 have been intermeshed with the monofilament loops 22 of the end edge of end portion 31. The hinge pin or pintle wire member 23 has been inserted through the intermeshed loops to hold the ends of the fabric together.

Figure 3A:
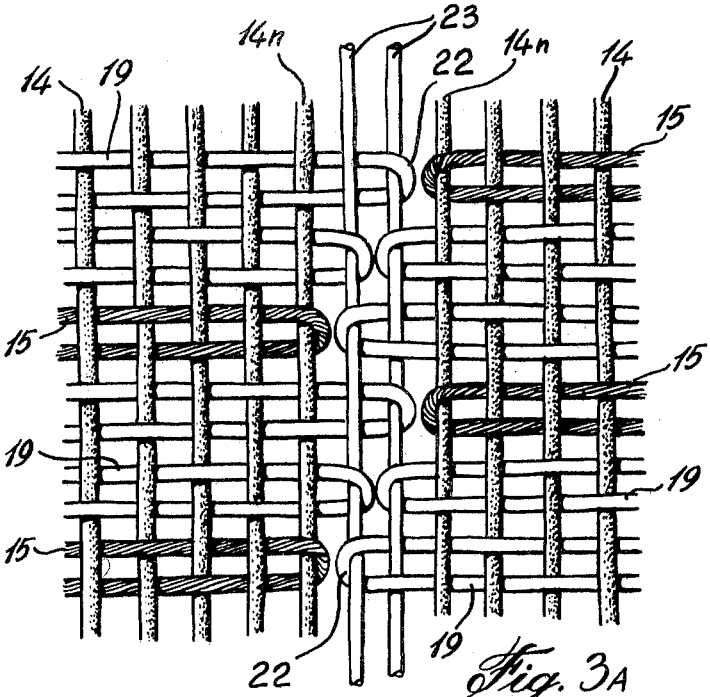
FIGS. 3*a* and 3*b* show a partial plan view and end elevation respectively, of a two pintle loop type seam in semi-twill fabric.
Figure 3B:
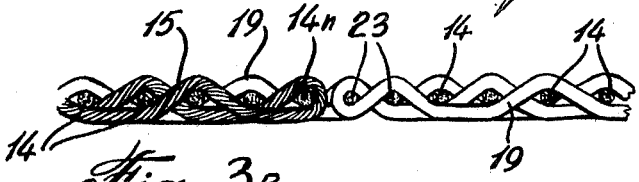

In some cases in order that replacement monofilament strands may be woven back in proper crimp sequence, certain of the loops will be formed longer than others. In semi-twill mesh pattern, for example, as shown in FIGS. 3*a* and 3*b*, when the first of every three consecutive longitudinal multifilament strands is woven around the last added cross strand and the two remaining strands are replaced by monofilament strands to form loops, it will be found that the crimps of the monofilament strands will fit better into the mesh if the loop of one of the remaining strands is made longer than the loop of the other. In cases like this where there are alternate long and short loops, the seam may be joined with two pintle wires as shown in FIGS. 3*a* and 3*b*.

Again, in some cases in which a hinge type seam is to be made in fabric having a complicated weave pattern in which a small number of the longitudinal strands have a crimp contour which is not symmetrical and is distinctive from the crimp contour of the rest of the strands which constitute the majority, it may happen that the asymmetrical strands will not fall in place in the mesh when attempts are made to weave them back into the cloth. In such cases, if it is not possible to fit the crimps in easily, even by twisting the strands about their own axes, it is permissible to simply eliminate them from the seam area by cutting them off at the end edges.

Figure 4:
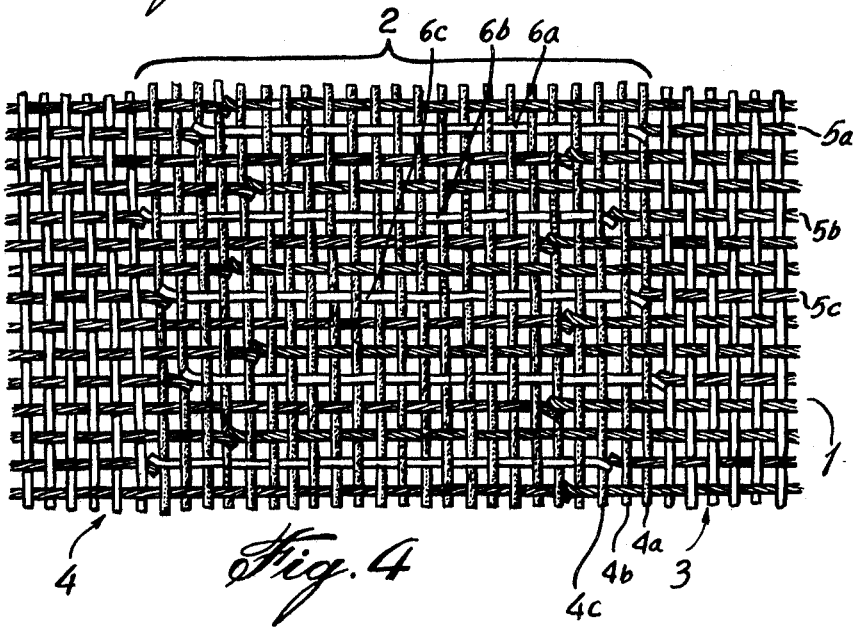
FIG. 4 is a partial plan view illustrating a factory made seam joining the ends of a plain woven fabric having multifilament longitudinal yarns.

Although particularly suitable for making pin type seams in fabrics that are to be joined after installation on the paper machine, the method of this invention may also be used for making substantially flat seams in factory joined endless paper machine fabrics having longitudinal strands incapable of retaining a crimp. FIG. 4 shows a portion of a factory joined seam in which the two ends 3 and 4 of a multifilament fabric 1 are woven together with added crimped across strands 4*a*, 4*b*, 4*c*, etc., in a seam area 2 and in which, according to the present invention, some of the longitudinal multifilament strands 5*a*, 5*b*, 5*c*, etc., in the seam area are replaced by monofilament strands 6*a*, 6*b*, 6*c*, etc., which have about the same diameter and substantially the same crimp configuration as the longitudinal multifilament strands of the fabric.

In another embodiment of the invention in which greater flexibility of the seam area is required and, at the same time, it may be desirable to restrict drainage in the seam area, it has been found practical to use two or more slightly smaller monofilament strands instead of single larger diameter monofilament strands for replacing multifilament longitudinal strands in the seam area. This modification can be adapted to either the looped woven seam of FIG. 1 or the factory woven seam of FIG. 4.

It will be understood by those skilled in the art of weaving in this manner at the ends of woven fabric to make endless fabric belts that while the strength of the seam depends on the number of added cross strands and the type and mesh of the fabric, the added cross strands should be kept to a minimum for the sake of economy. For example, in a woven loop seam made according to the invention and as shown in FIG. 1, the number of added cross strands for a typical dryer fabric of any woven pattern will vary from about 30 to about 100 at each end edge. In the case of a factory woven seam as shown in FIG. 4, the number of added cross strands between the ends of the fabric will vary from about 60 to about 200. The extent of the seam area will, of course, be taken into account in the preparation of the ends of fabric to be joined so that, when seamed, the total length of the fabric will be as required.

Following re-weaving in the seam area according to this invention, it is considered advisable to restore the rigidity of the fabric in the seam area by re-coating with the same thermo-setting resin material that was used to stiffen the fabric originally.

The monofilament replacement strands are crimped by any well known method in the art. Also, the interweaving of the seam area, with the strands as disclosed herein, is done in a manner well known in the art and not disclosed herein as it does not form part of the present invention.

I claim:

1. A woven fabric as used for supporting a paper web on a paper making machine, said fabric having interwoven weft and warp strands with the strands in the machine direction being flexible strands incapable of retaining a stable crimp, the improvement comprising a plurality of spaced apart replacement monofilame strands having stable crimp characteristics as replacement for a plurality of said machine direction flexible strands, said monofilament strands extending in the machine direction and in a seam area for interconnecting opposed ends of said fabric to form an endless belt having a seam which is substantially flat, said replacement monofilament strands having been substituted for flexible machine direction strands in said seam area and interwoven with added cross machine strands which are removed cross machine strands from said woven fabric seam area or strands taken from identical fabric, said replacement monofilament strands having crimps of the same configuration as crimps in the machine direction strands of the fabric.

2. A woven fabric as claimed in claim 1 wherein said fabric is a synthetic fabric and said flexible strands are multifilament strands.

3. A woven fabric as claimed in claim 2 wherein a plurality of pairs of two adjacent multifilament strands are removed from said seam area, each of said removed pairs being replaced by one of said replacement monofilament strands, said one replacement monofilament strand being looped and having opposed sections thereof extending in alignment with a respective severed end of said removed two multifilament strands and interwoven with weft strands extending transversely to said machine direction strands, the loops of each said one replacement monofilament strand extending beyond an end one of said weft strands.

4. A woven fabric as claimed in claim 3 wherein alternate pairs of said multifilament strands are replaced by said replacement monofilament strands, said loop end of each of said replacement monofilament strands being formed about a forming rod held adjacent said end one of said weft strands.

5. A woven fabric as claimed in claim 3 wherein said loop ends at said opposed ends are spaced apart whereby said loop ends of each opposed end are intermeshed and interconnected by a pin-like member extending through all said intermeshed aligned loops in the weft strand direction.

6. A woven fabric as claimed in claim 5 wherein said replacement monofilament strands are positioned in predetermined patterns and form loops of different predetermined lengths beyond said end one of said weft strands whereby said loop ends at said opposed ends form at least two aligned rows of loop ends to receive a respective one of two or more pin-like members therein in the weft strand direction when intermeshed.

7. A woven fabric as claimed in claim 3 wherein said two multifilament strands are severed at staggered locations whereby said severed ends terminate in relation to different weft strands.

8. A woven fabric as claimed in claim 1 wherein said replacement monofilament strands extend between opposed severed ends of selected ones of said longitudinal strands, said severed ends extending in a predetermined relationship in said seam area.

9. A method of forming a seam in a woven paper machine fabric having interwoven weft and warp strands with the strands in at least the machine direction being flexible strands incapable of retaining a stable crimp, said method comprising (i) removing a plurality of cross machine strands from an area in opposed end edge portions of said fabric, (ii) crimping a plurality of monofilament strands having stable crimp characteristics with a crimp identical to that in the strands of the fabric in said machine direction, (iii) substituting a plurality of said monofilament strands in said machine direction for at least some of the machine direction strands in the said opposed end edge portions, and (iv) interweaving said machine direction fabric strands and said monofilament strands in said machine direction with a plurality of added cross machine strands comprising said removed cross machine strands, or cross machine strands taken from identical fabric, to form a seam area.

10. A method as claimed in claim 9 wherein said step (iii) comprises:

severing and removing said at least some of the machine direction strands from said end edge portions, said monofilament strands being interwoven in alignment with opposed severed ends of aligned machine direction strands.

11. A method as claimed in claim 9 wherein said step (iii) comprises:

severing a plurality of pairs of two adjacent machine direction strands from said area in opposed end edge portions of said fabric, said machine direction strands being multifilament strands and said fabric being a synthetic fabric.

12. A method as claimed in claim 11 wherein said step (iv) comprises:

(a) interweaving opposed sections of one of said monofilament strands in alignment with a severed end of a respective one of said pairs of two adjacent multifilament strands, (b) interweaving weft strands extending transverse to said multifilament strands with said monofilament strands, and (c) forming a loop end extending beyond an end one of said weft strands in said opposed end edge portions.

13. A method as claimed in claim 12 wherein said step (iv) (c) comprises:

looping a portion of said monofilament replacement strands about a forming rod, removing said forming rod to form said loop end in each said replacement strands, and interconnecting said opposed end edge portions by intermeshing loops formed in each end edge portion to align said loops to position a pin-like member therethrough whereby to interconnect said end edge portions together.

* * * * *